United States Patent [19]

Harm

[11] 3,980,289

[45] Sept. 14, 1976

[54] INTERFOLDING APPARATUS

[75] Inventor: Alson Robert Harm, Sunman, Ind.

[73] Assignee: The Procter & Gamble Company, Cincinnati, Ohio

[22] Filed: Apr. 7, 1975

[21] Appl. No.: 565,929

[52] U.S. Cl. ..... 270/40
[51] Int. Cl.[2] ..... B41L 1/30
[58] Field of Search ..... 270/32, 39–40, 270/86, 79, 52

[56] References Cited

UNITED STATES PATENTS

| | | | |
|---|---|---|---|
| 1,122,511 | 12/1914 | Lazar | 270/40 |
| 1,489,833 | 4/1924 | Keller | 270/39 |
| 3,038,718 | 6/1962 | Balsam | 270/40 |
| 3,361,425 | 1/1968 | Benitez | 270/86 |
| 3,850,425 | 11/1974 | Marcalus | 270/40 |

*Primary Examiner*—Edgar S. Burr
*Assistant Examiner*—A. Heinz
*Attorney, Agent, or Firm*—Thomas J. Slone; John V. Gorman; Richard C. Witte

[57] ABSTRACT

An apparatus for simultaneously folding and interfolding a multiplicity of webs of flexible material such as facial tissue paper in the machine direction to form an endless bundle of interfolded webs which endless bundle can be cut into discrete bundles and packaged in pop-up dispensing containers. The apparatus comprises a fan-shape, horizontally disposed folding table comprising a set of tapered elongate guides having inverted V-shape cross sections. The elongate guides are disposed in side-by-side relation and thereby form tapered V-shape troughs therebetween. The webs are directed in convergent relation onto the radially outwardly disposed edge of the fan-shape table in partially overlapped relation and are drawn radially inwardly thereacross and thence about a turning guide whereupon the folds of the webs are alternately V-folded upwardly in said troughs and downwardly about the ridges of the elongate guides so that an edge fold of each web is disposed intermediate two folds of an adjacent web. The apparatus may also include an array of unwind backstands, and ply bonding and machine-direction slitting devices so that the multiplicity of webs can be supplied from a substantially smaller number of parent rolls.

7 Claims, 23 Drawing Figures

INTERFOLDING APPARATUS

FIELD OF THE INVENTION

This invention relates generally to fan-shape interfolding apparatuses wherein several webs are simultaneously folded and interfolded along fold lines extending in the machine direction while the webs are being drawn through the apparatus in side-by-side, partially overlapped relation. Such fan-shape interfolding apparatuses (hereinafter referred to as parallel-type interfolders) are thus distinguishable from folding apparatuses wherein webs are folded along fold lines extending transverse the machine direction, and from apparatuses wherein several webs are serially or sequentially interfolded.

BACKGROUND OF THE INVENTION

Prior art parallel-type interfolders and accordian pleating apparatuses are known which comprise sufficient folding guides that all folds are positively made about a machine member. Such apparatuses having a fan-shape array of elongate guides are exemplified by U.S. Pat. No. 1,122,511 which issued Dec. 29, 1914 to Solomon Lazar; U.S. Pat. No. 3,038,718 which issued June 12, 1962 to Maurice M. Balsam; U.S. Pat. No. 3,784,186 which issued Jan. 8, 1974 to Robert Lenthall et al.; and U.S. Pat. No. 3,850,425 which issued Nov. 26, 1974 to Nicholas Marcalus et al. A parallel type interfolding apparatus comprising guides having saw-tooth shape apertures through or between machine members is exemplified by U.S. Pat. No. Re 12,204 which issued Mar. 15, 1904 to Edwin D. Casterline. U.S. Pat. No. 3,536,317 which issued Oct. 27, 1970 to Ronald J. Billett interfolds wide sheets from parent rolls and slits them into facial tissue or napkin widths after the sheets have been interfolded by being passed between longitudinally extending guides.

These and other known interfolders commonly have problems such as access to machine members and adjustments, maintaining sufficient visible contact with the material-in-process for assuring quality control, and sufficiently controlling the folding and bundle formation to continuously and reliably produce square-cornered bundles of unwrinkled product. However, none of the discovered prior art interfolding apparatuses has solved the problems associated with interfolding in the manner nor to the degree of the present invention. For instance, in interfolding apparatuses comprising oppositely disposed guides, some guide members must be opened or moved to initially thread the webs therebetween whereas apparatuses embodying the present invention have no such oppositely disposed folding guides. That is, all of the webs being interfolded in an apparatus embodying the present invention are drawn across the top of a fan-shape folding table; not between elongate members or through saw-tooth apertures. Moreover, the preferred embodiment of the present invention has, as is described fully hereinafter, slitters which make slits visible to the machine operators, adjustable guide rollers for maintaining bundle squareness, and other improvements with respect to prior art apparatuses.

OBJECTS OF THE INVENTION

The nature and substance of the invention will be more readily appreciated after giving cosideration to its major aims and purposes. The principal objects of the invention are recited in the ensuing paragraphs in order to provide a better appreciation of its important aspects prior to describing the details of a preferred embodiment in later portions of this description.

A major object of the present invention is to provide a parallel-type interfolding apparatus wherein a multiplicity of webs of material such as facial tissue are associated to form a straight sided, square cornered, endless bundle of substantially unwrinkled webs which can be severed into discrete bundles and packaged in pop-up dispensing cartons.

Another major object of the invention is to provide the parallel-type interfolding apparatus described in the preceding paragraph wherein the multiplicity of webs are provided by slitting a plurality of parent rolls of the material in the machine direction.

A further object of the invention is to provide a parallel-type interfolding apparatus as described above in which a high degree of visible contact can be maintained with the material being interfolded therein.

Yet another object of the invention is to provide parallel-type interfolding apparatuses as described above in which folding guide members do not have to be moved to initially loop the webs about and/or across the guide members.

A still further object of the invention is to provide parallel-type interfolding apparatuses as described above which can be adjusted easily to enable interfolding fan-shape arrays of webs which arrays are disposed symmetrically or asymmetrically with respect to the centerline of the apparatus.

SUMMARY OF THE INVENTION

The above and other objects are achieved in accordance with one aspect of the present invention by providing an apparatus comprising an arcuate array of backstands for rotatably supporting and unwinding parent rolls of sheet material, slitting means for converting the sheet material into a multiplicity of webs, means for juxtapositioning the webs in partially overlapped relation, and means for causing the webs to be drawn in converging relation across a fan-shape folding table comprising a set of elongate guides having inverted V-shape cross sections and thence drawing the converged wegs about a turning guide having an axis. Means are provided for tilting the axis of the turning guide so that the webs can be caused to track along the ridges and V-shape troughs of the folding table. The apparatus may further comprise a second turning guide and means for tilting its axis so that, by adjusting the tilt of both axes, square-corners can be maintained on the endless bundle drawn between the two turning guides.

BRIEF DESCRIPTION OF THE DRAWINGS

While the specification concludes with claims particularly pointing out and distinctly claiming the subject matter regarded as forming the present invention, it is believed the invention will be better understood from the following description taken in conjunction with the accompanying drawings in which:

DESCRIPTION OF THE PREFERRED EMBODIMENT

Figure 1:
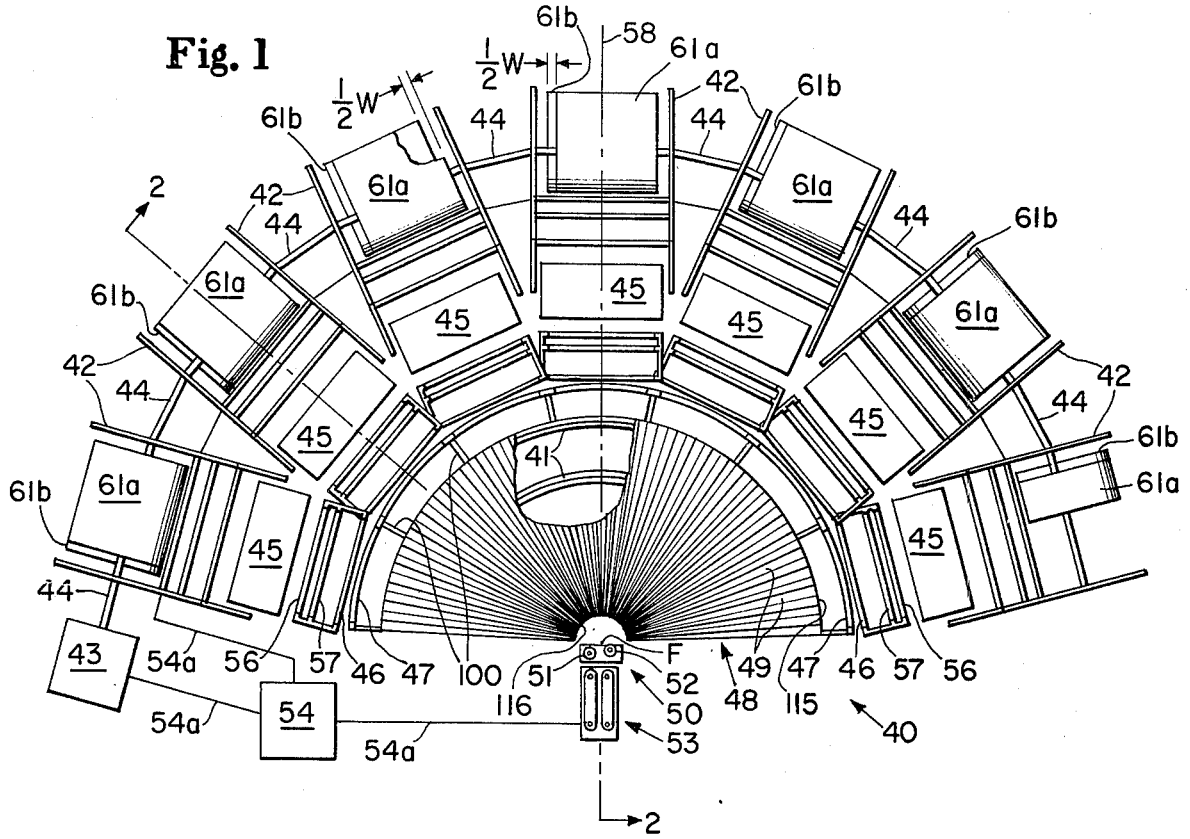
FIG. 1 is a partially broken away, plan view of a parallel-type interfolding apparatus embodying the present invention.
Figure 2:
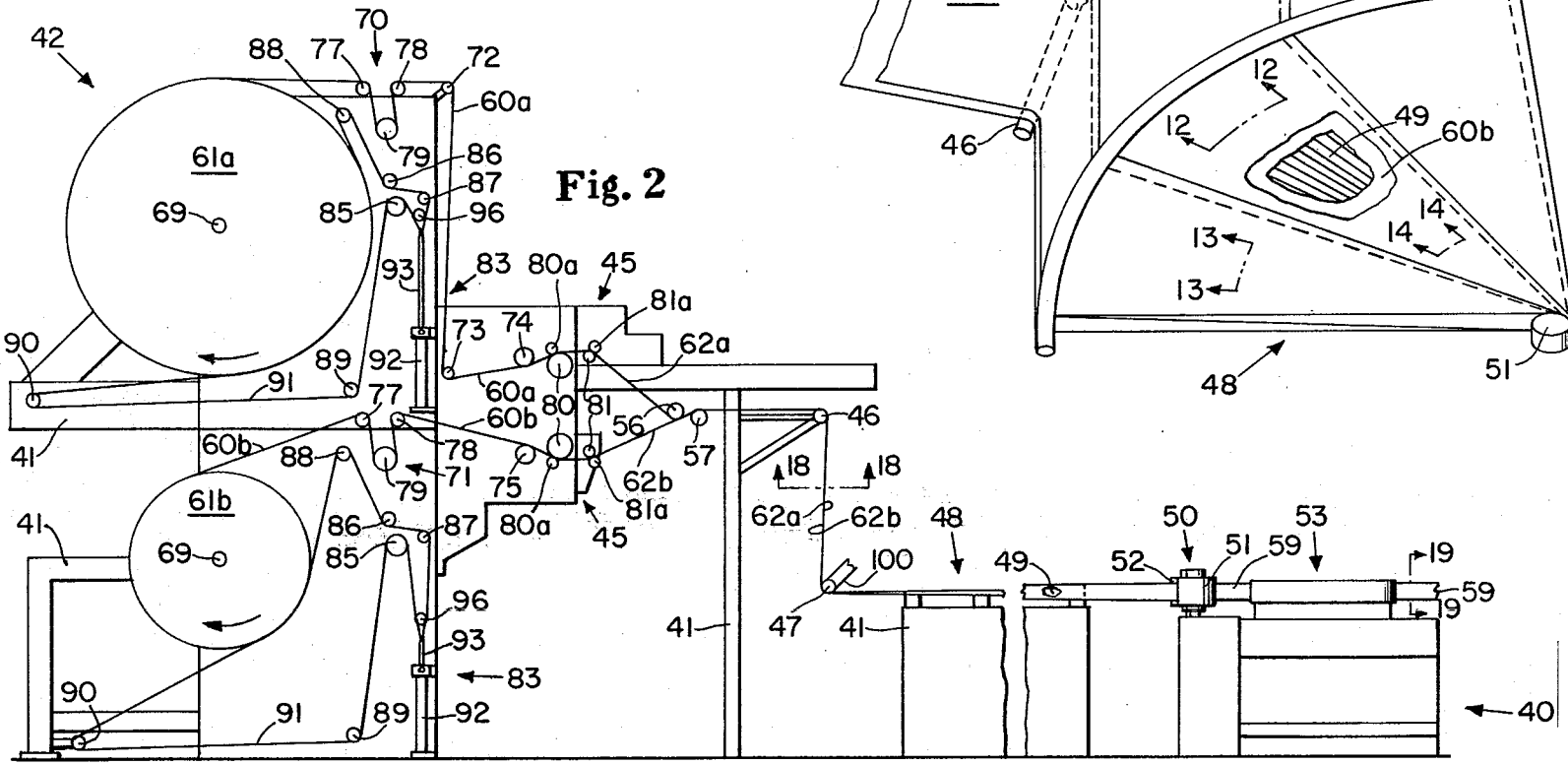
FIG. 2 is a fragmentary vertical sectional view of the interfolding apparatus shown in FIG. 1 taken along line 2—2 thereof.

Referring now to the drawings, and particularly to FIGS. 1 and 2, a preferred embodiment of the present invention is identified as interfolder 40 or, alternatively, interfolding apparatus 40 which comprises a frame 41, seven backstands 42, unwind drive 43, coupler shafts 44, an arcuate guide 47, a fan-shape folding table 48 comprising a set of elongate guides 49, turning guide means 50 comprising a pair of guide rollers 51, 52, draw means 53, controller 54, and control cables 54*a*. Each backstand 42 comprises ply-bonding and slitting means 45, two juxtapositioning idler rolls 56, 57, and a pre-arc roller 46.

The interfolder 40 enables directly converting a plurality of parent rolls of flexible, somewhat elastic sheet material such as creped, two-ply facial tissue paper into an endless bundle 59 comprising a multiplicity of interfolded webs. The endless bundle 59 can subsequently be severed by suitable downstream apparatus (not shown) into discrete bundles and packaged in pop-up dispensing cartons.

Figure 3:
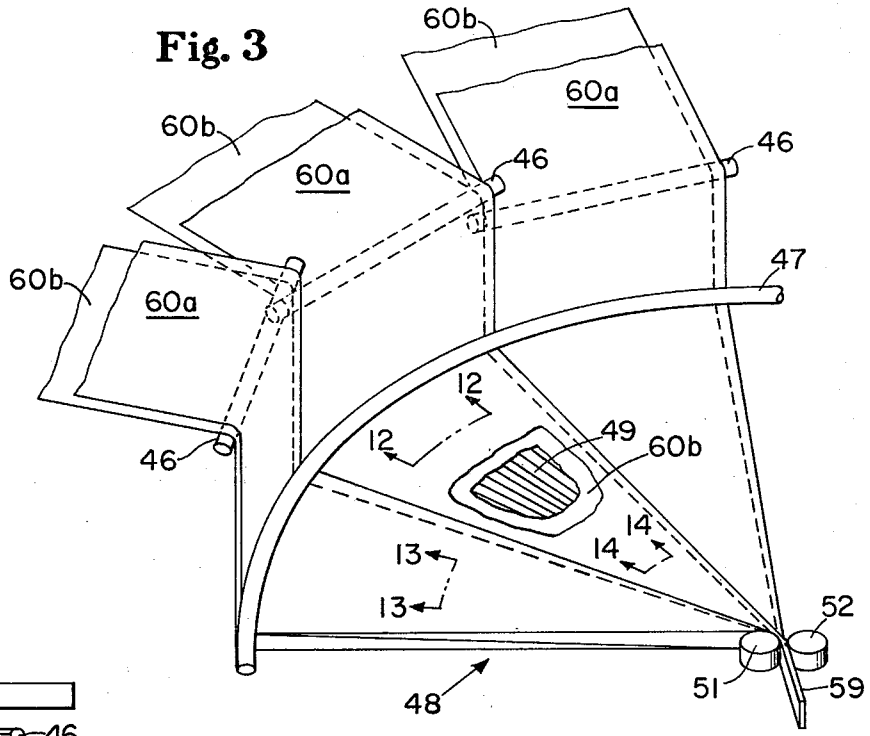
FIG. 3 is a fragmentary perspective view of the interfolding apparatus shown in FIGS. 1 and 2 which shows the respective locations of the pre-arc rollers, the arcuate guide, and the turning guides or rollers with partially overlapped sheets of flexible material looped over, under, and between those members respectively.

Briefly, sheets 60*a*, 60*b*, Figure 2, of flexible material are unwound by drive 43 from a plurality of upper and lower parent rolls 61*a*, 61*b*, respectively, mounted in the backstands 42, and the sheets are drawn through the interfolder by draw means 53. While being drawn through the interfolder, the sheets are ply bonded and slit in the machine direction by means 45, prior to being interfolded, whereby the sheets are converted into a multiplicity of webs 62*a*, 62*b* in side-by-side, parallel running relation. The webs are juxtaposed in half-overlapped relation, FIGS. 4 and 18, by virtue of having the upper parent rolls 60*a* axially offset from the lower parent rolls 61*b*, FIG. 1, and by passing the webs over pre-arc rollers 46 which are disposed at graduated elevations as shown in FIGS. 3 and 4. The half-overlapped webs, 62*a* and 62*b*, FIG. 2 are then looped under the arcuate guide 47 whereupon they are directed to converge and pass across the folding table 48 and thence between the guide rollers 51, 52. The relative dispositions of the arcuate guide 47, the elongate guides 49 of folding table 48, and the guide rollers 51, 52 cause the superjacent webs 62*a*, FIG. 4, to be folded downwardly about the ridges 64, FIGS. 6 through 11, of the elongate guides 49 of the folding table 48, and cause the subjacent webs 62*b*, FIG. 4, to be folded upwardly in V-shape troughs 65, FIGS. 12, 13 and 14, formed intermediate adjacent elongate guides 49. Thus, all of the webs 62 are folded along longitudinally extending hinge lines so that each overlapped fold (each half) of each web is disposed between the two folds or halves of the adjacent web, FIG. 18. Controller 54, FIG. 1, is provided to enable driving the plybonder anvil rolls 80, FIG. 2, at a controlled peripheral velocity, to enable unwinding the parent rolls through the use of tension sensing means 70, 71 so that all of the parent rolls are unwound under nominal yet positive predetermined uniform tension in the machine direction, and to control the draw means 53 to provide a predetermined nominal elongation of the somewhat elastic webs 62*a*, 62*b* intermediate the ply-bonding and slitting means 45 and the draw means 53.

As constructed, an exemplary preferred apparatus embodiment, FIGS. 1 and 2, comprises means for interfolding symmetrical as well as asymmetrical arrays of as many as 140 webs which webs are provided by longitudinally slitting sheets unwound from fourteen parent rolls disposed in seven two-high backstands. However, the preferred embodiment apparatus as described herein is used for interfolding an asymmetrical array of 126 webs which are provided by slitting 12 whole parent rolls and two narrow parent rolls which are three-tenths as wide as whole parent rolls. The array of 126 webs is asymmetrical because, by placing the narrow parent rolls in the right-end backstand, FIG. 1, seventy webs are disposed on the left side of the centerline 58 of the interfolder 40 while only 56 webs are disposed on the right side of the centerline 58 of the interfolder.

Each backstand 42, FIG. 2, comprises a portion of frame 41, shafts 69 for rotatably mounting an upper parent roll 61*a* and a lower parent roll 61*b* in frame 41, tension sensing means 70, 71, idler rolls 72, 73, and spreader rolls 74, 75.

The shafts 69 are disposed so that the upper and lower parent rolls 61*a*, 61*b*, respecitvely, FIG. 1, are axially offset with respect to each other a distance 1/2 W. This axial offsetting causes the webs of width W slit therefrom to be juxtaposed in half-overlapped relation upon passing juxtapositioning rolls 56, 57 as is described more fully hereinafter. Sideshift units, not shown, are also provided in the backstands 42 to enable positioning the parent rolls axially on shafts 69 to assure proper registration with the downstream ply-bonding and slitting means 45.

Tension sensing means 70 and 71 each comprise two idler rolls 77, 78, a tension responsive, movable dancer roll 79 and means not shown for converting the position and movement of dancer roll 79 into input signals to controller 54 via a control cable 54*a*, FIG. 1, so that all of the sheets 60 are unwound under uniform nominal tension in the machine direction.

Each backstand 42 further comprises a peripheral-drive unwind means 83, FIG. 2, for each parent roll comprising a drive pulley 85, idler pulleys 86 through 90 inclusive, a takeup pulley 96, two transversely spaced drive belts 91 (only one shown in FIG. 2) looped about the pulleys and a peripheral portion of the parent roll as shown in FIG. 2, and a constant tension air cylinder 92. Pressurized air, regulated by means not shown, is applied to the tension air cylinder 92 to retract its piston rod 93 and takeup pulley 96 as a parent roll 61 of sheet material is payed out so that an arcuate portion of each drive belt 91 is continuously maintained in driving relation with a peripheral segment of the parent roll.

Ply-bonding and slitting means 45, FIG. 2, are also provided in each backstand 42 to longitudinally slit each sheet 60*a*, 60*b* into a plurality of side-by-side webs and to compressively bond the plies of each multi-ply sheet together adjacent the longitudinally extending edges of each web.

Each ply-bonding and slitting means 45, FIG. 2, comprises a plybonder anvil roll 80, a plurality of plybonder wheels 80*a*, means (not shown) for selectively biasing the wheels 80*a* against the anvil roll 80 or spacing the wheels 80*a* from the anvil roll 80, a slitter anvil roll 81, a plurality of circular slitter knives 81*a*, and means (not shown) for selectively positioning the slitter knives 81*a* in cooperating relation with the slitter anvil roll 81 or spacing the wheels 81*a* from the slitter anvil roll 81.

Each slitting means 45 is provided with means not shown for controllably enabling and foregoing slitting. The capability of foregoing slitting is particularly useful because unslit sheets can be looped through the apparatus to initially thread the apparatus rather than having to loop the entire multiplicity of discrete webs through the machine. Moreover, by slitting each sheet into a number of discrete webs before interfolding occurs, the slitting can be visually monitored to assure good quality control. Furthermore, an advantage of slitting a plurality of parent rolls into a multiplicity of webs is that only a plurality of tension sensing means and associated controls are required as opposed to a number of tension sensing and control means equal to the number of webs. For instance, in the preferred embodiment apparatus, only fourteen tension sensing means 70, 71, FIG. 2, are required as opposed to 126 which would otherwise be required. Indeed, if whole parent rolls were installed in all seven backstands 42, a total of 140 webs could be provided under controlled tension through the use of the 14 tension sensing means 70, 71 provided in the seven backstands 42.

Unwind drive 43, FIG. 1, is connected by shafts 44 (and other members not shown) to each backstand 42 and its upper and lower ply-bonding and slitting means 45 so that anvil rolls 80 and 81 are driven through manually adjustable variable ratio drives (not shown), and so that the unwind drive pulleys 85 are driven through variable ratio drive means (not shown) which are responsive to the associated tension sensing means 70 or 71. The manually adjustable variable ratio drives enable adjusting all of the ply-bonding and slitting means 45 so that they synchronously meter all of the sheets 60*a*, 60*b* therethrough. Then, each unwind drive pulley 85 is independently coupled to unwind drive 43 through its own associated tension-responsive variable drive means to enable unwinding, under the control of controller 54, all of the parent rolls simultaneously under uniform tension. Thus, the machine speed is the peripheral velocity of the anvil rolls 80, 81 which speed is controlled through the use of controller 54, control cables 54*a*, and unwind drive 43, whereas the rate of unwinding each parent roll is independently controlled through the use of the tension sensing means and the tension-responsive variable speed drive means to achieve uniform machine-direction tension in all the sheets 60*a*, 60*b* being unwound. Each tension-responsive variable speed drive (not shown) responds, briefly, to low tension (downward displacement of its associated dancer roll 79) by slowing the peripheral velocity of the parent roll to increase tension, and each variable speed drive responds to high tension (upward displacement of its associated dancer roll 79) by increasing the peripheral velocity of the parent roll to decrease tension.

As will be described more fully hereinafter, the webs are synchronously forwarded from the ply-bonding and slitting means 45 by draw means 53.

As briefly referred to hereinbefore, the exemplary preferred embodiment interfolding apparatus 40, FIG. 1, comprises seven backstands 42 disposed in a semicircular array. Six of the seven backstands 42 have whole upper and lower parent rolls 61*a* and 61*b* installed therein whereas the seventh backstand has partial (not full width) parent rolls installed therein. Each of the 12 whole or full parent rolls thus provided is converted by its associated slitting means 45 into ten webs 62 and each of the two partial parent rolls is converted into three webs 62 for a total of 126 webs. The preferred embodiment apparatus 40 is sized and configured to interfold webs of two-ply facial tissue which are 8¼inches wide. Therefore, each whole parent roll is 82½inches wide and the partial parent rolls are 24¾inches wide. Alternatively, the parent rolls can be wider and the apparatus can further comprise edge trimming means (not shown) for the purpose of enabling each parent roll to provide a discrete number of webs of uniform width W, FIG. 4.

Figure 4A:
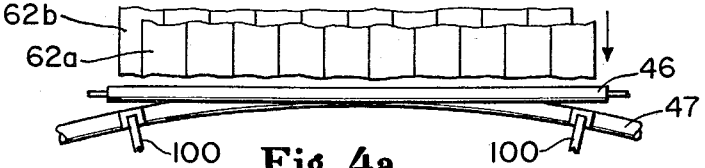
FIG. 4*a* is a fragmentary plan view showing a pre-arc roller disposed above a section of the arcuate guide so that the central portion of the pre-arc roller is in a chordal relation with respect to a portion of the arcuate guide.
Figure 4:
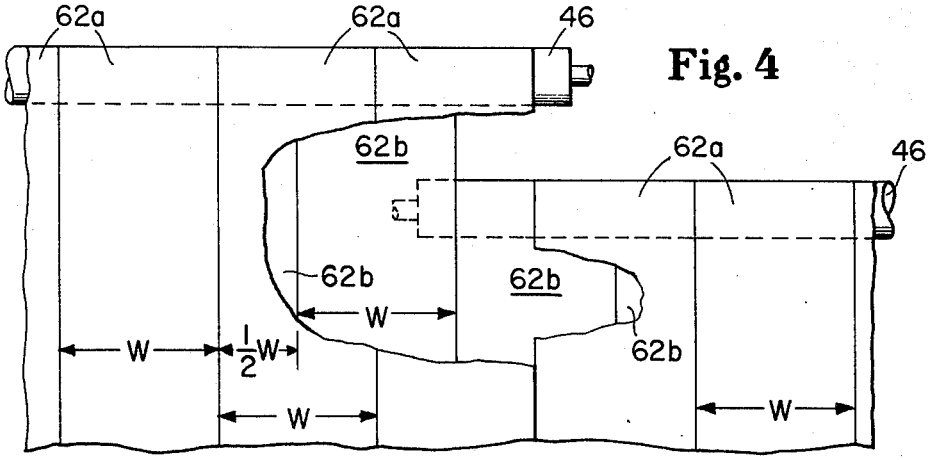
FIG. 4 is a fragmentary elevational view showing the overlapped and staggered relation between the ends of adjacent pre-arc rollers, and showning several webs of flexible material cascading downwardly therefrom in half-overlapped relation.
Figure 18:
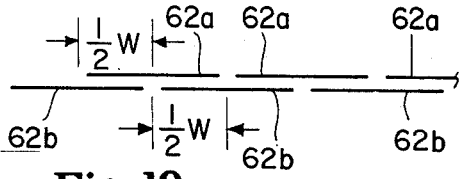
FIG. 18, taken along line 18—18 of FIG. 2, shows an end view of several webs of flexible material in half-overlapped relation with imaginary, non-existent spaces provided between the webs for clarity.

Referring now to FIGS. 3, 4 and 4*a*, the pre-arc rollers 46 are displaced at graduated, descending elevations (from left to right) above the arcuate guide 47 so that the adjacent webs provided by adjacent backstands can be justaposed in half-overlapped relation, FIG. 4, in the same manner that the webs supplied by each backstand are disposed in half-overlapped relation, FIGS. 4*a* and 18. Thus, by virtue of axially offsetting upper parent rolls 61*a*, FIG. 1, one-half web width from the lower parent rolls 61*b*, and by positioning the pre-arc rollers 46 at graduated elevations, all of the webs 126 in number in the exemplary preferred embodiment apparatus) are juxtaposed in half-overlapped relation prior to being looped under the arcuate guide 47.

For clarity in FIG. 3, the upper sheets 60*a* and the lower sheets 60*b* are not shown to be slit into discrete webs 62*a* and 62*b* respectively as they normally are. Such unslit sheets would exist, principally on start-up, while the slitting means 45 are disabled. Also for clarity, referring to FIGS. 4, 4*a* and 18, the discrete upper webs 62*a* and the discrete lower webs 62*b* are alternatively designated superjacent webs 62*a* and subjacent webs 62*b* respectively.

Figure 15:
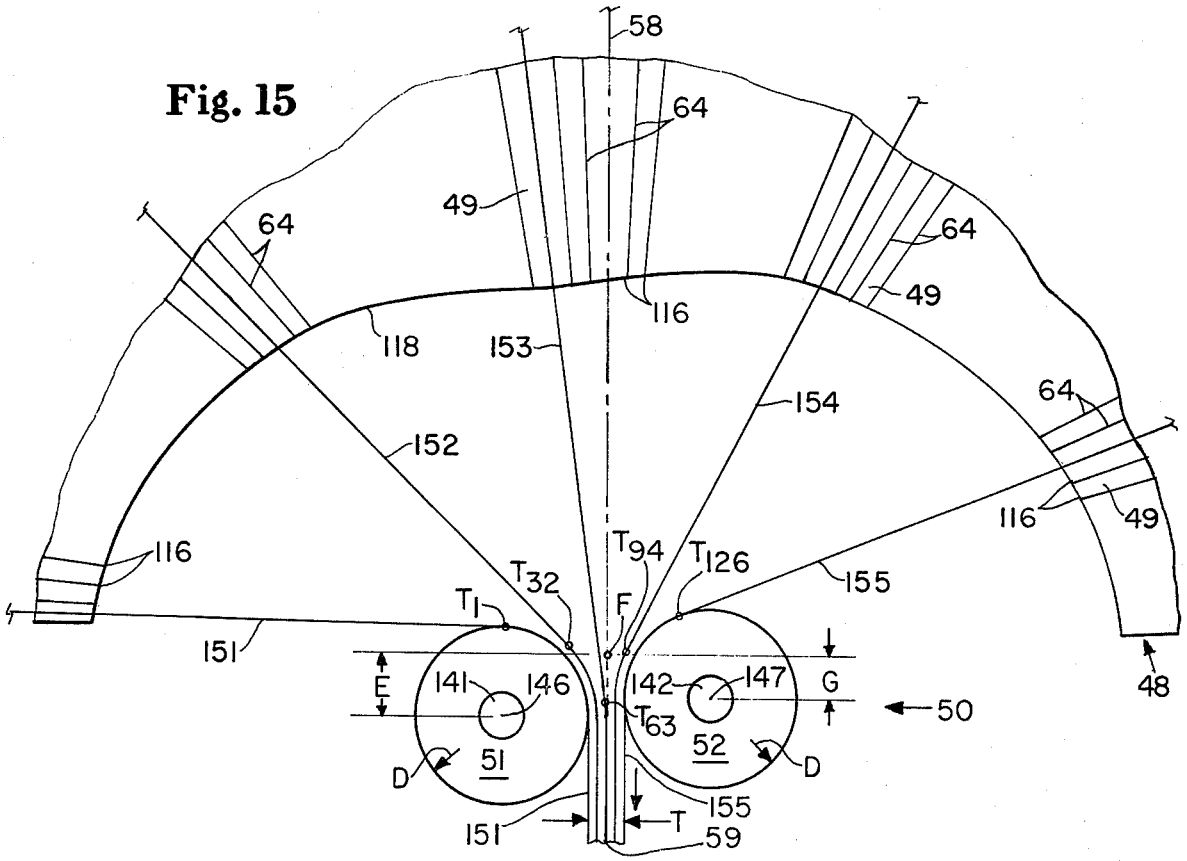
FIG. 15 is an enlarged scale, somewhat schematic plan view of the central portion of the folding table and the guide rollers of the interfolding apparatus shown in FIG. 1.
Figure 6:
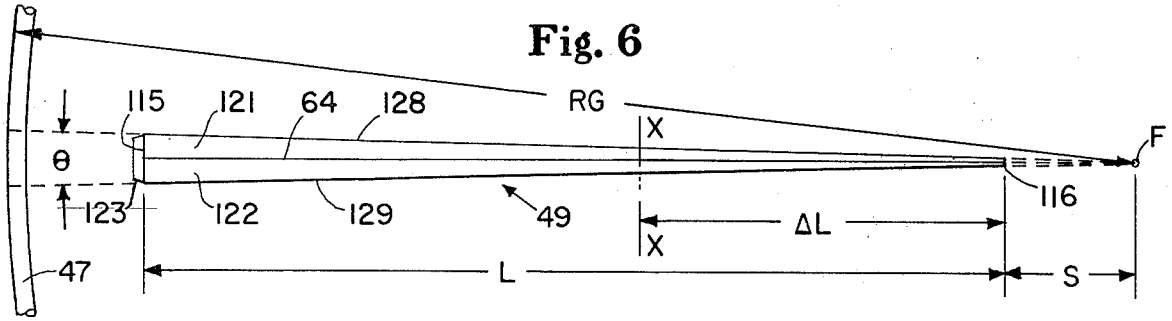
FIG. 6 is a fragmentary plan view of an elongate guide member showing the relationship between the plan view configuration of an elongate guide and an arcuate guide of uniform curvature.

Arcuate guide 47, FIGS. 1 and 6, of the preferred embodiment apparatus 40 has a uniform radius RG and its center of curvature is disposed at point F, FIG. 15, adjacent the guide rollers 51, 52 as will be further described in conjunction with FIG. 15.

Figure 5:
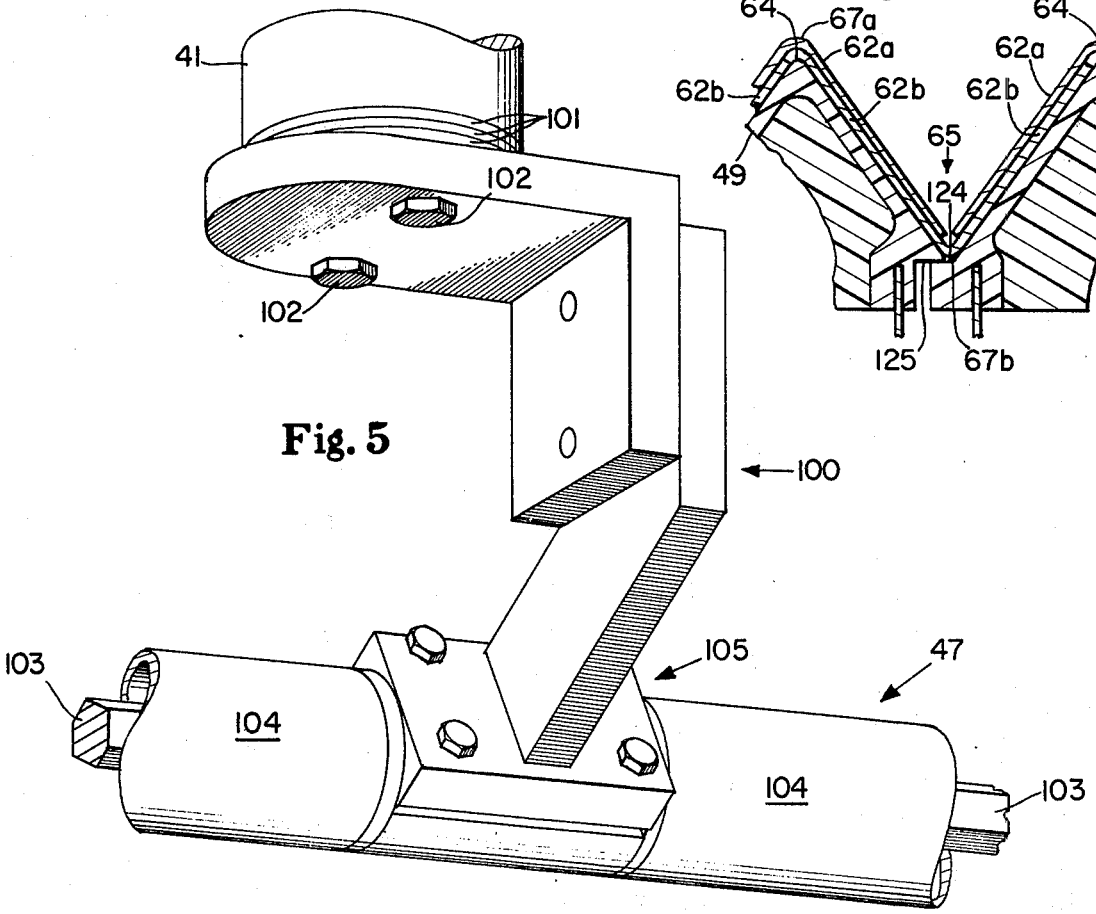
FIG. 5 is a fragmentary perspective view showing the juncture of two sections of the arcuate guide and one of several struts for cantilevering the arcuate guide from the frame of the interfolding apparatus.

The arcuate guide 47 is cantilevered from the frame 41 by a plurality of strut assemblies 100, as exemplified in FIG. 5, through the use of shims 101 and bolts 102 so that the elevation of the arcuate guide can be adjusted. As further shown in FIG. 5, the arcuate guide 47 is segmented by virtue of comprising a plurality of arcuate-shape core rods 103, flexible cylindrical sleeves 104, juncture means 105 for coupling adjacent core rods 103 together, and means not shown for rotatably securing the flexible sleeves 104 on the core rods 103. Thus constructed, the arcuate guide 47 comprises a plurality of freely rotatable arcuate sections and, but for the junctures 105, is an arcuate-shape idler roller. The segments of the arcuate guide 47 are rotated by the array of webs being turned thereabout as the webs are drawn from the pre-arc rollers 46 to the folding table 48, FIGS. 2 and 3.

In the exemplary preferred apparatus 40, the outside radius RG, FIG. 6, of the arcuate guide 47 is 189 inches so that the width of a web W, 8¼inches, FIG. 4, spans an arcuate length of about 2½degrees, angle Theta, of the arcuate guide. Thus, the arcuate guide 47 causes the webs which are guided thereonto in side-by-side, half-overlapped relation to nominally converge towards point F, FIG. 6. However, the exact convergent relationship is determined by the alignment of the elongate guides 49 with respect to the arcuate guide 47 and with respect to the guide rollers 51, 52 as further described hereinafter.

Figure 7:
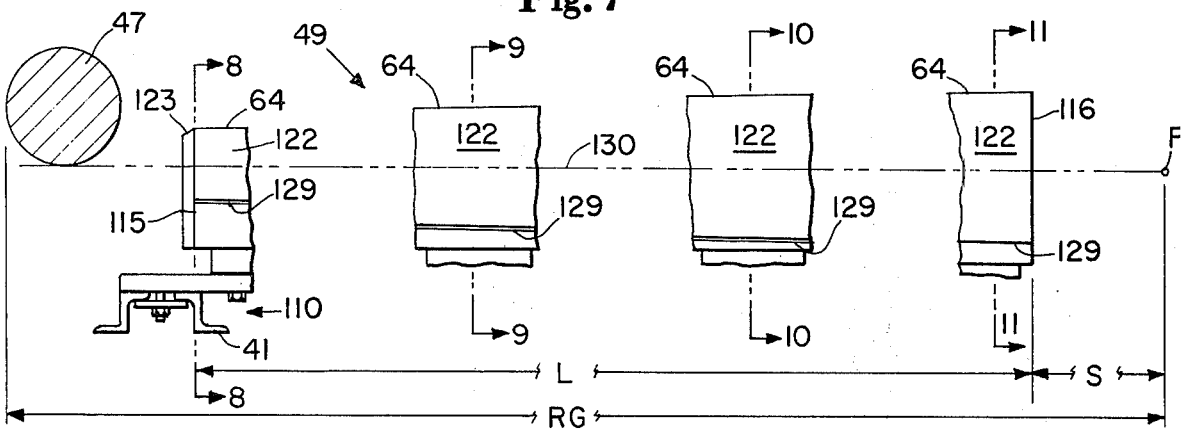
FIG. 7 is an enlarged scale, fragmentary foreshortened view of the elongate guide shown in FIG. 6 and its disposition relative to the arcuate guide.
Figure 8:
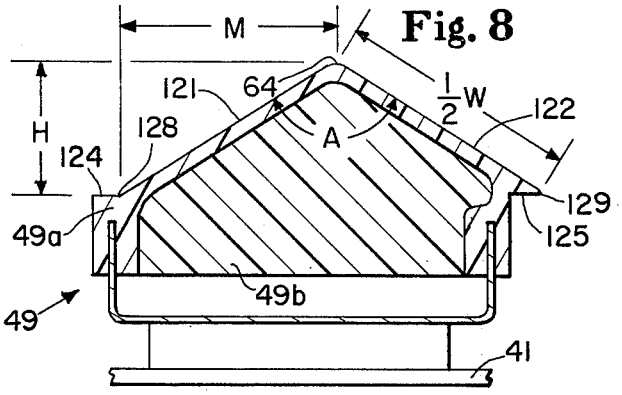
FIGS. 8 through 11 inclusive are sectional views of the elongate guide shown in FIG. 7 taken along lines 8—8, 9—9, 10—10, and 11—11 thereof respectively.
Figure 9:
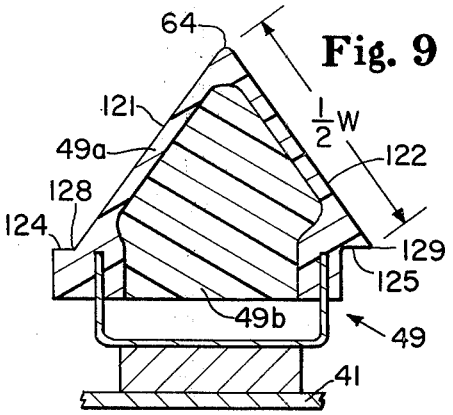
Figure 10:
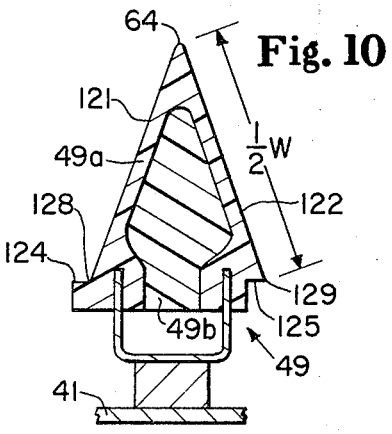
Figure 11:
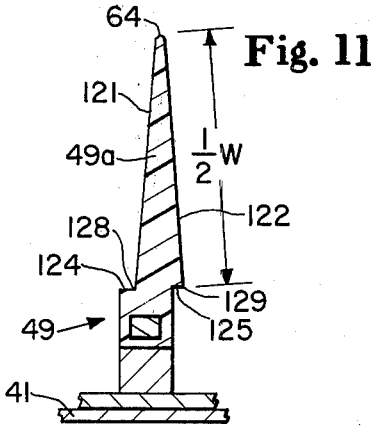

The folding table 48, FIG. 1, comprises a portion of frame 41, a set of elongate guides 49 which set numbers seventy-one in the preferred embodiment interfolder, and adjustable means exemplified by the attachment 110, FIG. 7, for individually securing the guides 49 to the frame 41. The attachments exemplified by 110 enable adjusting the position of each guide 49 radially as well as circumferentially so that each elongate guide can be independently aligned.

Each elongate guide 49, FIGS. 6 through 11 inclusive, has an inverted V-shape cross section, an apex ridge 64, outboard end 115, inboard end 116, sides 121, 122 having uniform widths of about ½ W throughout their lengths, an apex angle A, a chamfered nose 123, a shelf 124, an overhang 125, and side edges 128, 129.

Each elongate guide 49, FIGS. 6 through 11 inclusive, comprises a molded shell 49*a*, and a foamed plastic core 49*b*. It has a length L between its outboard end 115 and its side edges 128, 129 are, in the plan view of FIG. 6, straight lines which have an angle Theta therebetween. The side edges 128, 129 would, if extended radially inwardly, intersect at the point F spaced a distance S from inboard end 116. Furthermore, if extended radially outwardly, the side edges 128, 129 would be spaced an arc length W apart at a radius RG from point F; W being the width of a web 62 to be V-folded over the elongate guide, and RG being the outside radius of the arcuate guide 47. Furthermore, as also viewed in the plan view, FIG. 6, the ridge 64 of the elongate guide 49 bisects angle Theta. As stated hereinbefore, angle Theta is about 2½degrees in the preferred embodiment apparatus.

By designing the ridge 64 and the side edges 128, 129 to be straight lines, in the plan view, and the fact that, as previously stated, the sides 121, 122 are designed to be of uniform width ½ W throughout the length L, the height (exemplified by H in FIG. 8) of the sides of any transverse section X—X, FIG. 6, is a non-linear function with respect to the distance (Delta L + S) of the section X—X from F. This non-linear relationship causes the ridge 64 and the side edges 128, 129 to be arcuate-shape as indicated in the foreshortened side elevational view, FIG. 7. Indeed ridges 64 and the side edges 128, 129 are symmetrically curved above and below respectively, in the side elevational view, the neutral axis 130 of the elongate guide 49 as indicated in FIG. 7. Preferably, all of the neutral axes extend substantially horizontally and are in an imaginary plane which is also tangent to the bottom of the arcuate guide 47, FIG. 7.

Referring again to FIGS. 8 through 11 inclusive which are transverse sectional views of an elongate guide 49, the profiles of sides 121 and 122 in each sectional view are straight lines but for slightly rounding the ridge 64.

Figure 12:
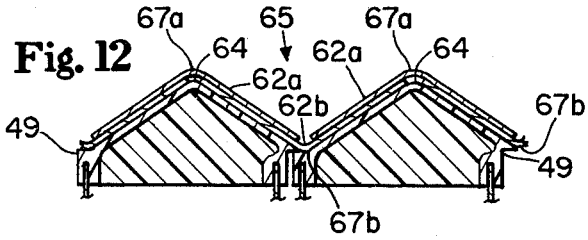
FIG. 12 is a fragmentary, enlarged scale, sectional view taken along line 12—12 of FIG. 3 showing the relationship between adjacent elongate guide members of the fan-shape folding table and the disposition of flexible webs being interfolded thereon.
Figure 14:
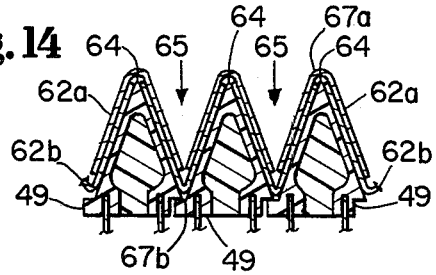
FIG. 14 is a fragmentary, enlarged scale, sectional view taken along line 14—14 of FIG. 3 which view is similar to FIG. 13 but in reduced scale relative to FIG. 13 with the interfolding progressed from the state shown in FIG. 13.
Figure 13:
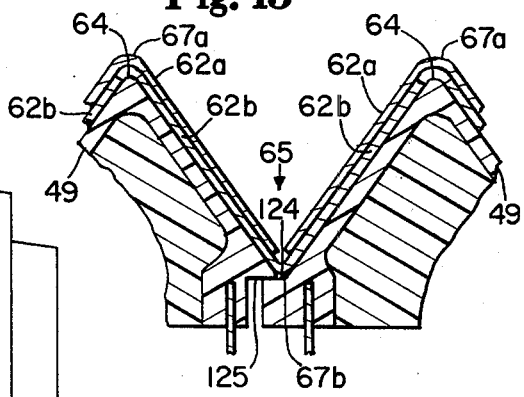
FIG. 13 is a fragmentary, extra enlarged scale, sectional view taken along line 13—13 of FIG. 3 which view is similar to FIG. 12 but in enlarged scale with respect thereto with the interfolding progressed from the state shown in FIG. 12.

Referring still to FIGS. 8 through 11 inclusive, the shelves 124 and the overhangs 125 of elongate guides 49 enable adjusting the center-to-center distances of guides 49 when they are secured and aligned in side-by-side relation to form the folding table 48, FIG. 1, without having an open space between adjacent guides. That is, the shelf 124 of each elongate guide is configured to fit underneath the overhand 125 of an adjacent elongate guide as shown in FIGS. 12–14 inclusive. The need for such interfitting of adjacent guide portions is, briefly, to avoid open spaces intermediate adjacent elongate guides 49 in order to obviate the possibility of having portions of webs extend lower than the side edges 128, 129 of the elongate guides as webs are drawn across the folding table 48.

Figure 16:
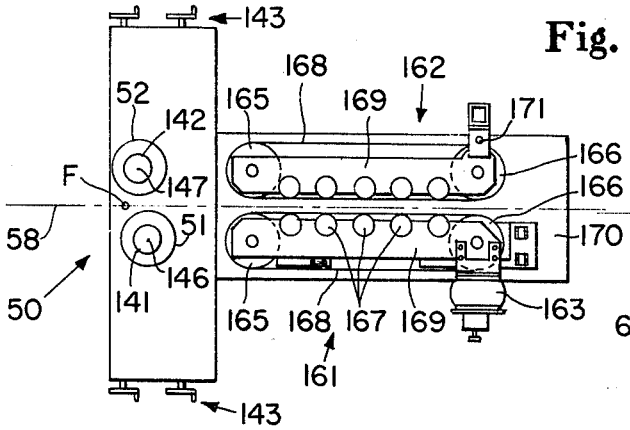
FIG. 16 is an enlarged scale, plan view of the turning guide and draw sections of the interfolding apparatus shown in FIG. 1.

Referring now to FIG. 16, turning guide means 50 comprises a pair of guide rollers 51, 52 which are rotatably mounted on shafts 141, 142, means 143 for universally tilting the shafts 141, 142, and means not shown for positioning the shafts 141, 142 so that the centers 146, 147 of rotation of the guide rollers 51, 52 are in predetermined spaced relations with respect to F, the center of curvature of the arcuate guide 47, and with respect to the longitudinal centerline 58 of the interfolding apparatus 40, FIG. 1.

FIG. 15 is a fragmentary, somewhat schematic plan view of the central portion of the interfolding apparatus 40 showing the spatial relationships between the apex ridges 64 of the elongate guides 49 of the folding table 48, the guide rollers 51, 52, the center-of-curvature F of the arcuate guide 47 and the longitudinal centerline 58 of the apparatus 40.

The space T, FIG. 15, between guide rollers 51, 52 is the nominal uncompressed thickness of the endless bundle 59 of interfolded webs being drawn therebetween. The centers 146, 147 of guide rollers 51 and 52 respectively are spaced distances E and G respectively downstream from F, the center of curvature of the arcuate guide 47. The guide rollers 51, 52 have equal diameters D. In the preferred embodiment apparatus, D is about twelve inches, E is about 3.12 inches, and G is about 2.06 inches.

Referring back to the elongate guides 49, they are secured to the frame 41, FIG. 1, in a fan-shape array with their radially outwardly disposed ends, outboard ends 115, spaced radially inwardly from the arcuate guide 47, and with their radially inwardly disposed ends, inboard ends 116, spaced from point F, the center of curvature of the arcuate guide 47, and from guide rollers 51, 52 as shown in FIG. 15. While being secured to frame 41, the arcuate guides are individually aligned and spaced as described below.

All of the elongate guides 49 are individually aligned so that their ridges 64 are aligned with the longitudinal hinge lines of the superjacent tissues **62*a* (FIG. 4) where they come under the arcuate guide 47, FIG. 2, and so that each ridge 64 is aimed at an imaginary point of tangency to accumulated folded tissues being drawn past the guide rollers 51, 52. That is, line 151, FIG. 15, is aligned with the valley or trough between the first and second elongate guides (numbered) clockwise from left to right) and is tangent to guide roller 51 at point $T_1$. The medial line or hinge line of the first subjacent web 62*b* follows this line 151 and is the first web directed about the periphery of guide roller 51. In a similar manner, lines 152, 153 are the hinge lines of the superjacent webs 62*a* having their hinge lines aligned with the ridges 64 of the seventeenth and thirty-second elongate guides respectively and show that webs drawn thereacross are directed tangentially, at points $T_{32}$ and $T_{63}$ respectively, onto the accumulated webs being drawn past guide roller 51. Also in a similar manner, lines 154, 155 are the hinge lines of superjacent webs 62*a* having their hinge lines aligned with the ridges 64 of the forty-eighth and the sixty-fourth elongate guides 49 respectively and show that webs drawn thereacross are directed tangentially, at points $T_{94}$ and $T_{126}$ respectively, onto the accumulated webs being drawn past guide roller 52.**

As a group, the inboard ends 116 of all the elongate guides 49 are so disposed that they define a serpentine-shape line 118, FIG. 15.

Line 118, FIG. 15, is established as follows. Referring back to FIG. 6, the sides 121, 122 of each elongate guide 49 would converge at a point spaced a distance S radially inwardly from the inboard end 116 of the guide. In the preferred embodiment apparatus 40, the inboard end 116 of each elongate guide 49 is spaced this distance S from its respective point of tangency; $T_1$, $T_{32}$, for example. In the exemplary apparatus, S is 22 inches.

In an alternate embodiment apparatus (not shown) each elongate guide is designed so that, as a group, their outboard ends can be uniformly spaced from the arcuate guide, and so that the side edges of each individual elongate guide would, in the plan view, if extended radially inwardly, converge at its associated point of tangency with respect to the guide rollers or the accumulated webs being drawn thereabout. This alternate embodiment apparatus may further comprise an arcuate guide of non-uniform radius wherein each arcuate portion associated with an elongate guide has a nominal center-of-curvature disposed at the respective point-of-tangency of its associated elongate guide.

As previously stated, as each subjacent web **62*b*, FIGS. 12–14 inclusive, is drawn radially inwardly across the folding table 48, its longitudinally extending medial line or hinge line 67*b* tracks along the bottom of a trough 65 and the side edges of the web track along two adjacent ridges 64 whereby the subjacent web is V-folded upwardly in the trough 65. Concurrently, as each superjacent web 62*a* is drawn radially inwardly across the folding table 48, its longitudinally extending medial line or hinge line 67*a*, FIGS. 12 and 13, tracks along the ridge 64 of an elongate guide 49 and the side edges of the web track along the side edges 128, 129 of the same elongate guide 49 whereby the superjacent web is V-folded downwardly over an elongate guide 49. In this manner, each web is V-folded so that each of its folds (halves) that was disposed in overlapping relation with a fold of another web, FIG. 4, becomes sandwiched between two folds of the other web. In conjunction with this description, it is believed to be important that, while the superjacent webs 62*a* are V-folded downwardly over machine members (elongate guides 49), the subjacent webs 62*b* are not folded over or about machine members. Rather, the subjacent webs 62*b* are folded about one fold each of two adjacent superjacent webs 62*a*.**

As described above, the hinge line of the first subjacent web (numbered clockwise in FIGS. 1 and 15) is aligned with the trough between the first and second elongate guides and the first web is V-folded upwardly in that trough. Then, proceeding clockwise around the array of elongate guides, odd numbered webs (subjacent webs **62*b*) are V-folded upwardly in other troughs and the even numbered webs (superjacent webs 62*a*) are V-folded downwardly over the elongate guides. Thus, web number 126 in the preferred embodiment apparatus is a superjacent web 62*a*** whose longitudinal centerline follows the ridge of elongate guide number 64.

Moreover, by virtue of the neutral axes being disposed in an imaginary plane which is tangent to the bottom edge portion of the arcuate guide 47 as stated hereinbefore, as each web travels radially inwardly from the arcuate guide 47 and across the folding table 48, the medial centerline of each fold of each web remains in the imaginary plane and each fold is rotated in a spiral manner about its medial centerline to effect the folding of the webs.

As stated hereinbefore, the folding table 48 of the exemplary preferred embodiment apparatus comprises a set of seventy-one elongate guides and only 126 webs are drawn across only 64 of the elongate guides, the array of 126 webs is asymmetrically disposed with respect to the longitudinal centerline of the apparatus. It is this asymmetrical relationship that precipitates the asymmetrical relationship (described hereinbefore) of the guide rollers 51, 51 with respect to point F. That is, the guide rollers 51, 52 are positioned to essentially be disposed symmetrically with respect to the centerline of the array of webs being drawn between them. The centerline of the array of webs is, for all intents and purposes, line 153, FIG. 15. Were the array of webs symmetrical with respect to the centerline 58 of the interfolder 40, FIG. 1, the axes of guide rollers 51, 52 would be symmetrically disposed about centerline 58 and equally spaced from point F.

As also stated hereinbefore, guide rollers 51, 52 have, in the preferred embodiment apparatus, approximately 12 inch diameters D, and are spaced 1½inches apart; distance T. Thus, the ratio between the guide roller diameters D and the spacing T (the uncompressed bundle height) between the guide rollers is about 8 : 1. It has been found that substantially smaller ratios precipitate an undesirable level of buckling and wrinkling of tissues adjacent the peripheries of the guide rollers. Furthermore, substantially larger diameter guide rollers precipitate an undesirably large deviation in the spacing of the inboard ends of the elongate guides from point F when the guides are individually aligned with points-of-tangency as described hereinbefore.

Further with respect to the freely rotatable guide rollers 51, 52, FIG. 15, it is believed that the fact that the webs are not compressed therebetween enables air trapped between the folds of the webs to escape as the webs converge towards the guide rollers 51, 52, and during the period of time the endless bundle 59 of webs is drawn towards and compressed by the draw means 53. This prolonged period for the escape of trapped air is believed to be a substantial improvement over prior art interfolding apparatuses wherein webs are converged towards and compressed directly between driven guide rollers or belts.

The means 143, FIG. 16, for tilting the shafts 141, 142 of the guide rollers 51, 52 provide means for causing the webs to track the ridges 64 and troughs 65 of the folding table 48 and for maintaining square corners on the endless bundle 59 of webs being drawn between the guide rollers. That is, by independently tilting the axes of the guide rollers 51, 52 more or less, the webs being drawn thereacross can be made to ride at the same elevation about the guide rollers whereby the endless bundle is assured of having square corners. That is, the cross-sectional shape of the endless bundle can be maintained rectangular whereas the cross-section might otherwise be a parallogram-shape without right angle corners.

Figure 17:
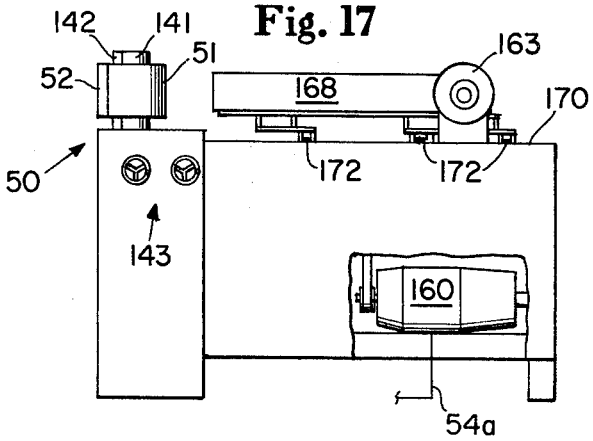
FIG. 17 is a side elevational view of the turning guide and draw sections shown in FIG. 16.

The draw means 53, FIGS. 16 and 17, comprises a variable speed drive motor 160, two oppositely disposed belt conveyors 161, 162, and means not shown for the motor to synchronously drive the conveyors.

Each conveyor, FIG. 16, comprises two end rolls 165, 166, a plurality of idler rollers 167, and an endless belt 168. The end rolls and the idler rolls are rotatably secured to upper chassis plates 169 and to lower chassis plates (not shown) so that the facing portions of the belts 168 which contact the webs are substantially planar.

The conveyors 161, 162 of the draw means 53 are mounted on a horizontally extending surface 170 by pivotally attaching the downstream end of conveyor 162 to the surface by a vertically extending pivot pin 171. The conveyors are further provided with rollers 172 so that they will be free to align themselves with an endless bundle of webs drawn therebetween.

The oppositely disposed downstream ends of the conveyors are biased towards each other by the air cylinder 163 and the upstream ends are biased towards each other by another air cylinder (not shown). The degree of biasing is controllable by pressure regulating means not shown and, during the operation of the apparatus is adjusted to enable the draw to draw the endless bundle 59 of interfolded webs therebetween. Furthermore, the degree of biasing of the upstream ends is substantially less than the downstream ends so that the endless bundle is gradually compressed as it negotiates the run between the belts.

The variable speed drive motor 160 is drivingly connected to the conveyors by means (not shown) to synchronously drive the conveyors. The speed of motor 160 is controlled by controller 54, FIG. 1, via a control cable **54*a* so that the draw means 53 supplies the traction required to synchronously pull all of the webs all of the way from the plybonder rolls 80, and so that a predetermined elongation of the webs occurs intermediate the plybonder rolls 80 and the draw means 53. By virtue of the webs being somewhat elastic the predetermined elongation imparted by the draw means causes sufficient tension to be maintained in the webs in the machine direction to obviate slack webs intermediate the plybonder rolls and the draw means. Obviating slack webs provides adequate control of the webs to cause them to be interfolded as they are drawn across the folding table 48**.

In another embodiment of the apparatus (not shown), similar to interfolder 40, for interfolding substantially inelastic material, tension control means are provided intermediate the plybonder rolls and the draw means to maintain sufficient machine-direction tension in the webs to obviate slack webs.

To prepare for operation of apparatus 40, FIGS. 1 and 2, whole and partial parent rolls **61*a*, 61*b* are installed in the backstands 42. Then, sufficient lengths of the unslit sheets 60*a*, 60*b* are unwound from each parent roll to be looped as shown in FIG. 2 about the rolls, through the ply-bonding and slitting means 45, over the pre-arc rollers 46, downward and under the arcuate guide 47, across the folding table 48, and thence between the guide rollers 51, 52 and through the draw means 53. During the threading, the plybonder wheels 80*a* are spaced from the plybonder anvil rolls 80, and the slitter knives 81*a* are spaced from the slitter anvil rolls 81. After being threaded, the plybonder wheels 80*a* are moved into cooperating relation with their respective anvil rolls 80. Then, the drive 43 and the draw means 53 are started under the control of the controller 54 whereby unslit sheets are unwound and drawn through the apparatus. Upon being drawn therethrough, the sheets will be caused to conform to the ridges 64 and troughs 65 of the folding table 48 by virtue of the bottom edge of the arcuate guide 47 being disposed at about or slightly below the elevation of the neutral axes of the elongate guides 49, FIG. 7, and by sufficiently adjusting the tilt of the guide rollers 51, 52 with means 143. When the sheets have thus begun to track the ridges 64 and troughs 65 of the folding table 48, the slitter knives 81***a* are moved into cooperating relation with their respective anvil rolls 81 whereupon the slitting of the sheets into webs begins. The medial lines of the superjacent webs 62*a* then track the ridges 64 of the elongate guides 49, and the medial lines of the subjacent webs 62*b* track along the bottoms of the troughs 65 whereupon the subjacent webs 62*b* are progressively V-folded upwardly in the troughs 65, FIGS. 12–14 inclusive, and the superjacent webs 62*a* progressively V-folded downwardly over the ridges 64. In this manner, each overlapped fold or half of each web is sandwiched between the two folds or halves of the adjacent web as stated hereinbefore.

The controller 54 acts, in conjunction with the tension control means 70, 71, to simultaneously unwind all the parent rolls under uniform, nominal predetermined tension up to the nips intermediate the plybonder anvil rolls 80 and the plybonder wheels 80*a*, and controls draw means 53 so that a predetermined elongation is imparted to each web intermediate the plybonder nips and the draw means 53 so that, ultimately, the apparatus issues an endless bundle 59, FIGS. 2 and 15, of interfolded webs at a controlled rate.

Figure 20:
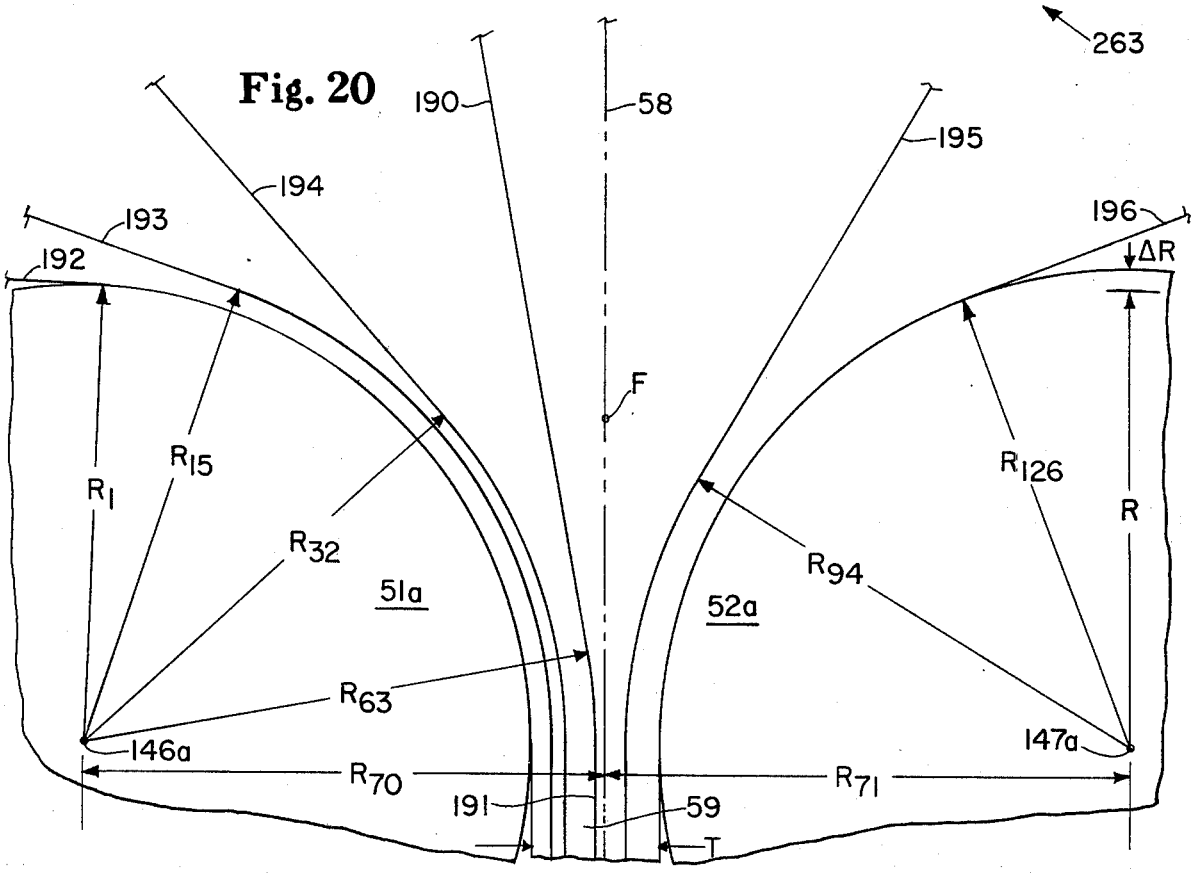
FIG. 20 is a plan view of an alternate embodiment turning guide roller assembly.

An alternate configuration of guide rollers is shown in FIG. 20, to comprise guide rollers 51*a*, 52*a*. In this configuration the axes 146*a*, 147*a* of the guide rollers 51*a*, 51*b* are symmetrically disposed with respect to the centerline 58 of the apparatus and are equally spaced downstream from point F, the center of curvature of the arcuate guide. However, the radius of guide roller 52*a* is Delta-R greater than the radius R of guide roller 51*a*. Delta-R equal to the composite thickness of the number N of webs required to make the number of webs disposed to the right of centerline 58 equal to the number of webs disposed to the left of centerline 58 of the apparatus. When the preferred embodiment apparatus which could interfold a symmetrical array of 140 webs is used as described hereinbefore to interfold an asymmetrical array of 126 webs, the number N is 14 and Delta-R is about .167 inch.

Still referring to FIG. 20, the centerline 190 of the asymmetrical array of 126 webs and the centerline 191 of the endless bundle 59 are displaced from the centerline 58 of the apparatus with 70 webs disposed leftward and 56 webs disposed rightward from the centerline 58 of the apparatus. As indicated by lines 192–196 inclusive, the webs are tangentially led onto the guide rollers 51*a*, 52*a* and the previously accumulated webs being drawn thereabout at points of tangency in the manner previously described herein with respect to the preferred embodiment apparatus. Radial lines $R_1$, $R_{15}$, $R_{32}$, $R_{63}$ and $R_{70}$ indicate the respective distances from axis 146*a* of the points of tangency for the first, fifteenth, thirty-second, sixty-third, and seventieth webs respectively, and radial lines $R_{71}$, $R_{94}$, and $R_{126}$ indicate the respective distances from axis 147*a* of the points of tangency for the seventy-first, ninety-fourth, and one-hundred-twenty-sixth webs respectively.

Figure 21:
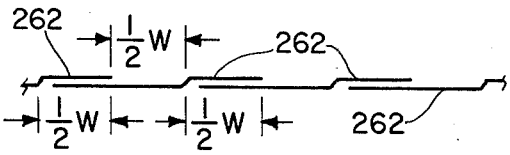
FIG. 21 is an end view of several webs of flexible material in one-third-shingled relation with imaginary non-existent spaced provided between the webs for clarity.
Figure 22:
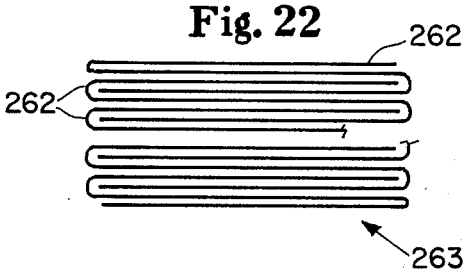
FIG. 22 is a transverse cross-sectional view of an endless bundle of webs of the type formed by interfolding, according to the present invention, an array of one-third-shingled webs as shown in FIG. 21.

FIGS. 21 and 22 show, respectively, a number of alternate webs 262 in one-third-overlapped shingled relation, and a bundle 263 of webs 262 formed by Z-interfolding the shingled webs. Such a bundle of Z-folded webs having a width of 1½ W can be formed by an alternate embodiment interfolding apparatus, not shown, comprising the arcuate guide 47, the folding table 48, turning guide means 50, and draw means 53 which are all shown and described herein. This alternate embodiment apparatus further comprises means (not shown) for forwarding to the arcuate guide, an array of webs in the one-third-overlapped shingled relation shown in FIG. 21. The folds of these webs would alternately be folded upwardly in the troughs 65 and downwardly over the ridges 64 of the folding table 48 so that each overlapped fold of each web is sandwiched between two folds of the adjacent web to ultimately enable pop-up dispensing.

Figure 19:
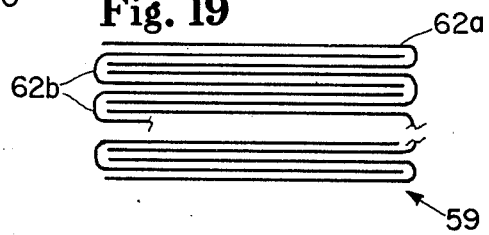
FIG. 19, taken along line 19—19 of FIG. 2, shows a transverse cross-sectional view of an endless bundle of webs of the type formed by interfolding, according to the present invention, an array of half-overlapped webs as shown in FIG. 18.

Other alternate embodiments of interfolding apparatus comprising the same arcuate guide 47, folding table 48, and turning guide means 50 as the preferred embodiment interfolder 40, FIGS. 1 and 2, can be provided to interfold webs comprising more than two folds, FIG. 18, or three folds, FIG. 21. For webs comprising two edge folds and an even number of intermediate folds, the webs would have to be arrayed so that their edge folds were in alternate overlapped relation as shown in FIG. 19. The configuration shown in FIG. 19 is the species of this generic class wherein the number of intermediate folds is the even number zero. For webs comprising two edge folds and an odd number of intermediate folds, the webs would have to be arrayed so that their edge folds were in the overlapped-shingled relation as shown in FIG. 21. The configuration shown in FIG. 21 is the species of this generic class wherein the number of intermediate folds is the odd number one.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. An apparatus for simultaneously and progressively folding and interleaving a multiplicity of running webs of flexible material to continuously form a substantially endless composite bundle of interleaved webs, each of the webs comprising a predetermined number of at least two longitudinally extending folds which folds are hingedly secured together along longitudinally extending, transversely spaced fold lines, the folds being designated edge folds each of said folds having a predetermined width and a predetermined uncompressed thickness, said apparatus comprising:

a frame;

means secured to said frame for juxtapositioning the webs in partially overlapped relation with an edge fold of each web disposed in overlapped relation with an edge fold of another web;

means secured to said frame for alternately V-folding adjacent folds of the webs upwardly and downwardly along the spaced fold lines so that each of the overlapped folds is disposed intermediate an edge fold and another fold of said another web, said V-folding means comprising a set of tapered elongate guides and a turning guide having a turning surface, each said elongate guide having an outboard end, an inboard end, a horizontally extending neutral axis, an inverted V-shape cross-section, and an apex ridge, said elongate guides being secured to said frame in side-by-side relation to form a tapered V-shape trough between each two elongate guides and to form a substantially horizontally disposed fan-shape folding table having alternately spaced said apex ridges and said V-shaped troughs forming an upwardly facing working surface with said inboard ends spaced from said turning guide, and with said apex ridges disposed in convergent relation and extending radially inwardly towards said turning guide, said apparatus further comprising web drawing means and alignment means for simultaneously drawing the multiplicity of webs generally radially inwardly across said working surface of said folding table with said fold lines alternately aligned with said convergent apex ridges and the bottoms of said troughs respectively to cause said webs to become fully folded, and thence drawing the webs about said turning surface of said turning guide, said apex ridges of said elongate guides being so aligned with respect to points of tangency to said turning surface and previously accumulated fully folded webs disposed radially inwardly therefrom which webs being drawn thereabout that said fold lines remain aligned with their respective apex ridges and troughs until the folding of each respective web has been completed at its respective point of tangency adjacent said turning surface and said previously accumulated fully folded webs.

2. The apparatus of claim 1 wherein said guiding means comprises a substantially horizontally disposed arcuate-shape guide, and means for independently aligning said elongate guides, said arcuate-shape guide being spaced sufficiently radially outwardly from said outboard ends of said elongate guides and secured to said frame by securement means to provide means for looping the webs about a portion of said arcuate-shape guide and across said folding table so that a line of tangency of the webs with said arcuate guide is disposed in an imaginary plane defined by the neutral axes of said elongate guides so that the medial centerline of each fold remains in the imaginary plane as the webs are drawn across said folding table and each fold is rotated about its medial centerline to effect the folding of the webs of flexible material.

3. The apparatus of claim 2 further comprising an arcuate array of unwind backstands comprising means for rotatably mounting a plurality of parent rolls of sheet material, means for paying out a sheet of said sheet material from each of said parent rolls in timed relation with said web drawing means, and means for slitting each said sheet into a group of the webs in parallel relation, said means for juxtaposing the webs comprising a pre-arc guide for each backstand and means for securing said pre-arc guides to said frame at sufficiently graduated elevations to provide means for looping all of the webs about said pre-arc guides and thence about said portion of said arcuate-shape guide in partially overlapped relation.

4. The apparatus of claim 3 wherein each backstand comprises means for rotatably mounting an upper parent roll and a lower parent roll which are axially off-set an amount equal to the width of one said fold of a web so that, when the sheets are payed out and slit into webs having two folds of equal width, the webs are in half-overlapped relation with the webs from the upper parent roll superjacent the webs from the lower parent roll.

5. The apparatus of claim 2 further comprising another turning guide disposed adjacent said turning guide so that both said turning guides are symmetrically disposed with respect to the centerline of the multiplicity of webs being drawn over said folding table.

6. The apparatus of claim 5 wherein said turning guides are guide rollers, said apparatus further comprising means for rotatably mounting said guide rollers on said frame, and means for independently tilting the axes of said guide rollers so that the cross-sectional shape of said endless bundle can be controlled.

7. The apparatus of claim 6 wherein the ratio of the diameters of said guide rollers to the composite uncompressed thickness of said folds forming said endless bundle is about 8 to 1.

* * * * *

UNITED STATES PATENT AND TRADEMARK OFFICE

CERTIFICATE OF CORRECTION

PATENT NO. : 3,980,289

DATED : September 14, 1976

INVENTOR(S) : ALSON ROBERT HARM

It is certified that error appears in the above-identified patent and that said Letters Patent are hereby corrected as shown below:

Column 2, line 45, "wegs" should be...webs...

Column 3, line 7, "showning" should be...showing...

Column 5, line 23, "respecitvely" should be... respectively...

Column 6, line 13, "opposied" should be...opposed...

Column 8, line 64, "overhand" should be...overhang...

Column 14, line 53, after "ignated edge folds" add... and other folds,...

Signed and Sealed this

First Day of February 1977

[SEAL]

*Attest:*

RUTH C. MASON
*Attesting Officer*

C. MARSHALL DANN
*Commissioner of Patents and Trademarks*